US010595136B2

(12) United States Patent
Yee et al.

(10) Patent No.: US 10,595,136 B2
(45) Date of Patent: Mar. 17, 2020

(54) METHOD FOR OPERATING A HEARING DEVICE AND HEARING DEVICE SYSTEM

(71) Applicant: SIVANTOS PTE. LTD., Singapore (SG)

(72) Inventors: Dianna Yee, Munich (DE); Homayoun Kamkar-Parsi, Erlangen (DE); Henning Puder, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/287,420

(22) Filed: Feb. 27, 2019

(65) Prior Publication Data

US 2019/0268704 A1 Aug. 29, 2019

(30) Foreign Application Priority Data

Feb. 28, 2018 (DE) ..... 10 2018 203 018
Mar. 14, 2018 (DE) ..... 10 2018 203 907

(51) Int. Cl.
*H04R 25/00* (2006.01)

(52) U.S. Cl.
CPC ..... *H04R 25/505* (2013.01); *H04R 25/407* (2013.01); *H04R 25/552* (2013.01); *H04R 2225/43* (2013.01)

(58) Field of Classification Search
None
See application file for complete search history.

(56) References Cited

U.S. PATENT DOCUMENTS 10,034,092 B1 * 7/2018 Nawfal ..... H04R 5/04
2015/0289064 A1 * 10/2015 Jensen ..... H04R 25/30 381/317
2016/0192090 A1 * 6/2016 Gran ..... H04R 25/552 381/23.1
2016/0241975 A1 8/2016 Jensen et al.
2016/0345107 A1 * 11/2016 Van Dijk ..... H04R 25/505
2018/0054683 A1 2/2018 Pedersen et al.
2018/0262847 A1 9/2018 Pedersen et al.

FOREIGN PATENT DOCUMENTS

EP 3373603 A1 9/2018

OTHER PUBLICATIONS

Dianna,Yee , et al. "A Noise Reduction Postfilter for Binaurally Linked Single-Microphone Hearing Aids Utilizing a Nearby External Microphone", IEEE/ACM trans. Audio, Speech & Language Processing 26(1), pp. 5-18, 2018.

* cited by examiner

*Primary Examiner* — Paul W Huber
(74) *Attorney, Agent, or Firm* — Laurence A. Greenberg; Werner H. Stemer; Ralph E. Locher

(57) ABSTRACT

A method operates a hearing device. A first input signal is generated by a first input transducer of the hearing device from an ambient sound signal. An external input transducer outside of the hearing device generates an external input signal from the ambient sound signal. A relative transfer function from the external input transducer to the hearing device with respect to a target signal source is ascertained based on the first input signal and/or external input signal. The external input signal is filtered by the relative transfer function, thereby generating an estimated target signal. Noise suppression takes place in the hearing device based on the estimated target signal.

14 Claims, 3 Drawing Sheets

METHOD FOR OPERATING A HEARING DEVICE AND HEARING DEVICE SYSTEM

CROSS-REFERENCE TO RELATED APPLICATION

This application claims the priority, under 35 U.S.C. § 119, of German application DE 10 2018 203 018.9, filed Feb. 28, 2018 and German application DE 10 2018 203 907.0, filed Mar. 14, 2018; the prior application is herewith incorporated by reference in its entirety.

BACKGROUND OF THE INVENTION

Field of the Invention

The invention relates to a method for operating a hearing device, wherein a first input transducer of the hearing device generates a first input signal from a ambient sound signal, an external input transducer generates an external input signal outside of the hearing device from the ambient sound signal, and noise suppression takes place in the hearing device based on the external input signal.

Using external input signals for noise suppression in hearing devices has become particularly important due to the increasing availability of such external input signals. Especially as a result of the increasing use of mobile telephones to provide external input signals by a microphone of the mobile telephone, and the opportunities that mobile telephones create for transmitting the external input signal to a hearing device, a wearer of the hearing device may receive a better sound quality of an output sound signal generated by the hearing device, particularly in conversational situations in which interference noise is superimposed on the contributions of a conversation partner.

In this regard, to date, the use of the external input signal has been particularly relevant for estimating the useful or target signal contributions of a conversation partner and distinguishing the same from noise. This happens, for example, under the assumption that the wearer of the hearing device positions the mobile telephone in front of his body and thus slightly closer to a frontal conversation partner than the hearing device, and as a result it has a slightly improved signal-to-noise ratio (SNR) for a frontal useful signal, as compared to an input signal generated in the hearing device itself. As a result, it is possible, for example, to recognize the periods of time during which the conversation partner is speaking who is standing in front of the wearer of the hearing device. The actual signal processing is then carried out on the input signals of the hearing device, with knowledge of these periods of time.

However, to date it has still not been meaningfully feasible to use signal components of an external input signal to generate an output signal in a hearing device in the sense that the signal components experience only frequency band-dependent amplification and/or compression, but otherwise directly enter the output signal, due to the difficulty of determining the positioning of the mobile telephone relative to the conversation partner and the resulting problems of spatial hearing.

SUMMARY OF THE INVENTION

The invention accordingly has the objective of providing a method for operating a hearing device, in which the sound quality is improved by use of an external input signal. The invention has the additional objective of providing a hearing device system with an external input transducer, by which such a method may be carried out.

The first objective is achieved according to the invention through a method for operating a hearing device, wherein a first input transducer of the hearing device generates a first input signal from an ambient sound signal, and an external input transducer generates an external input signal outside the hearing device. A relative transfer function from the external input transducer to the hearing device with regard to a target signal source is determined from the first input signal and/or external input signal. The external input signal is filtered using the relative transfer function, thereby generating an estimated target signal, and noise suppression in the hearing device takes place based on the estimated target signal. Advantageous configurations, which are themselves inventive in part, are the subject matter of the dependent claims and the following description.

An input transducer in this case, in particular, contains an acousto-electrical transducer, for example as at least one microphone. The hearing device in this case does not comprise the external input transducer; rather, the transducer is spatially separated from it, and in particular is arranged in a housing. The external input transducer is in this case preferably arranged in a parent apparatus that the housing surrounds, for example a mobile telephone, or in particular is arranged in an additional external unit that is configured and intended specifically to be used together with the hearing device, but not to be worn on the ear, and also is only optional for proper operation of the hearing device and therefore should not be assigned to the hearing device per se.

To carry out the method, the external input signal from the parent apparatus may be transmitted to the hearing device, so that the individual method steps are carried out in the hearing device. Alternatively, the first input signal may also be transmitted to the parent apparatus of the external input transducer, so that parts of the method are carried out in the parent apparatus, and, for example, the estimated target signal is transmitted to the hearing device for further processing there.

In this case, the relative transfer function of two input signals $x_1(n)$, $x_2(n)$ generated at different locations, with respect to a sound source S, is defined in the discrete frequency domain as the quotient of the two transfer functions $H_{S1}(k)$, $H_{S1}(k)$ from the sound source to the respective location where the input signal was generated, and thus in the frequency domain:

$$X_1(k)=H_{S1}(k)\cdot S(k), \quad \text{i)}$$

$$X_2(k)=H_{S2}(k)\cdot S(k), \quad \text{ii)}$$

$$X_1(k)=H_{21|S}(k)\cdot X_2(k) \quad \text{iii)}$$

with the relative transfer function $H_{21|S}(k)=H_{S1}(k)/H_{S2}(k)$ with respect to S, where $X_j(k)$ is the signal corresponding to $x_j(n)$ in the frequency domain and S(k) denotes the signal generated by the source S (in the frequency domain). In this case, in particular an acoustic delay between the two generating locations and thus a phase difference of the two input signals occurring in the frequency domain is taken into account.

By filtering the external input signal using the relative transfer function from the external input transducer to the hearing device with respect to a target signal source, the estimated target signal in the hypothetical ideal case of a perfect determination of the relative transfer function corresponds exactly to the sound signal arriving at the hearing device from the direction of the target signal source. However, suitable measures may be taken to minimize deviations in the determination of the relative transfer function, so that in substance the estimated target signal contains the signal components of a target signal generated by the target signal source. This information may now be used for noise suppression.

In this case, use may also be made of the fact that the wearer of the hearing device may choose the position of the external input transducer in particular in order to position it favorably with respect to the target signal source, for example in front of the wearer's body, thus not only achieving a higher signal amplitude of the target signal compared to the diffused background noise due to the greater spatial vicinity, but also contributing to the shielding effect of the wearer's body against directional noise interference generated from the direction of the target signal source, in addition to improving the SNR in the external input signal.

The noise suppression takes place in particular based on an estimated noise signal, which is generated based on the estimated target signal and the first input signal. By means of the information regarding the signal components of the target signal that is present in the target signal, an estimated noise signal may correspondingly be determined that contains information about the noise component, by means of appropriate comparisons with other signals that are present and also have a high target signal component due to how they are generated and optionally how they are further processed. Noise suppression based on the estimated noise signal may now be carried out, for example, by determining a spectral noise power density, and on this basis, frequency band-specific weighting coefficients are determined for processing the first input signal in the hearing device.

In this case, it is possible in particular to exploit the fact that the external input signal advantageously, from the start, has a better SNR than the first input signal owing to a favorable positioning of the external input transducer or its parent apparatus with respect to the target signal source. Conventional methods for noise suppression in a hearing device determine the noise component during pauses between the speech contributions of a conversation partner. However, such an approach is no longer possible, especially in the case directional interference, such as may be present in speech contributions of a speaker positioned substantially behind the wearer, and as a result the noise suppression may lead to considerable errors and artifacts in the output signal. The present method circumvents these problems because, unlike the first input transducer of the hearing device, the external input transducer may be positioned so that such interference is not misinterpreted as a "useful signal" due to its non-stationary character.

In this case, the estimated target signal, which represents the signal components of the target signal from the target signal source, is preferably subtracted from the first input signal or from a first intermediate signal derived from the first input signal, the first intermediate signal particularly preferably being constructed such that it has at least the same proportion of target signal, or at least the same SNR, as the first input signal has. On the assumption that the useful signal component in the first input signal largely originates from the target signal, subtracting the estimated target signal from the first intermediate signal delivers an estimated noise signal, in particular in the case mentioned, and this noise signal is meaningful for noise suppression in generating the first intermediate signal, but is also significant for the quality of the estimated target signal and thus for estimating the relative transfer function.

The first intermediate signal may be generated in particular from the first input signal by applying frequency band-specific noise suppression, wherein the attenuation factors of the individual frequency bands may be determined, for example, via statistical models and/or based on spectral power densities. In this case, the first intermediate signal is a first noise-suppressed signal, from which the estimated target signal for generating the first noise signal is subtracted.

Particularly preferably, the relative transfer function is generated based on the external input signal by means of an adaptive filter, in which the estimated noise signal is received as an error signal, and in which the filtering of the external input signal also takes place, so that preferably the output signal of the adaptive filter is the estimated target signal. In this case, it may be advantageously utilized that in particular, a first noise-suppressed signal, being the first intermediate signal, should have only a small noise component and in particular a high SNR, so that the adaptive filter subtracting the estimated target signal output should largely cancel out the signal components of the target signal in the first intermediate signal, and the remaining noise represented by the estimated noise signal that has been generated in this manner provides a meaningful measure of the quality of the adaptation to the relative transfer function.

Preferably, the step size of the adaptive filter is controlled in dependence on the external input signal of the first input signal. This may be done, for example, by determining a probability of an occurrence of certain signals with respect to which the noise suppression is to be optimized from the external input signal and/or first input signal, and controlling the step size is controlled as a function of this probability. In particular, such a signal, with respect to which noise suppression is optimized, may be a target signal from the frontal direction.

Favorably, a second input signal is generated by a second input transducer of the hearing device from the ambient sound signal, and the relative transfer function from the external input transducer to the hearing device with respect to a target signal source is ascertained based on the first input signal and/or second input signal and/or external input signal. As a result, the external input signal provides additional spatial information that may be used, to reduce undesired remaining symmetries of a directional characteristic of the corresponding directional signal, in particular with respect to the frontal plane of the wearer, particularly when forming directional signals based on the first input signal and second input signal.

In this case, the first input signal and the second input signal are preferably respectively generated in two different local devices of a binaural hearing device, so that one of these two input signals is generated on the left side of the wearer's head, and the other input signal is generated on the right side of the wearer's head. However, these two input signals may both be generated in a monaural hearing device, which the wearer wears on one ear.

The relative transfer function is ascertained in particular by generating a first directional signal based on the first input signal and the second input signal, and the relative transfer function from the external input transducer to the hearing device with respect to the target signal source based on the first directional signal and the external input signal. In this case, the first directional signal may be generated in particular in such a way that as a result of the directional effect, the noise suppression that takes place is frequency-band-by-frequency-band or broadband, so that the first directional signal is an embodiment of the first noise-suppressed signal and consequently one particular embodiment of the first intermediate signal.

In this case, the estimated noise signal is preferably formed by subtracting the estimated target signal from the first directional signal. The first directional signal already has an improved SNR compared to the two input signals used, because of the noise suppression, in particular the suppression of diffuse interference, taking place in the formation of the first directional signal. The subtraction makes it possible to make a statement about the quality of the estimate of the relative transfer function based on the determined deviation of the estimated target signal component from the first directional signal, in particular in the event that there is a target signal component in the participating input signals.

This approach is in particular combined with an adaptive filter for determining the relative transfer function and in particular for generating the estimated target signal from the external input signal, wherein the estimated noise signal, which is preferably estimated from the first directional signal and the estimated target signal, is received in the adaptive filter as an error signal.

The step size of the adaptive filter may be controlled in particular as a function of a probability of a frontal target signal source, which is preferably ascertained based on the external input signal and the first input signal and/or the second input signal. In this case, an adaptation with high step size is preferably carried out when there is a high probability of a target signal from the frontal direction. In this case, it is precisely the estimated noise signal that is particularly meaningful for the quality of the adaptation of the adaptive filter, due to the high target signal component in the participating input signals. One way to ascertain this probability is described in Dianna Yee, A. Homayoun Kamkar-Parsi, Rainer Martin, Henning Puder, "A Noise Reduction Postfilter for Binaurally Linked Single-Microphone Hearing Aids Utilizing a Nearby External Microphone", IEEE/ACM trans. Audio, Speech & Language Processing 26(1), pp. 5-18, 2018.

The noise suppression may on the one hand be such that a noise suppression parameter is ascertained based on the estimated noise signal and is applied to a second intermediate signal derived from the first input signal. An output signal is generated based on the noise-suppressed second intermediate signal, and an output transducer of the hearing device generates an output sound signal from the output signal. This means in particular that the estimated noise signal is used for this purpose, for example via determining a spectral power density or other frequency band-dependent parameters such as amplification factors or also to ascertain the parameters involving directional effect in a directional signal that serves as a second intermediate signal, without the signal components of the external input signal, however, being put directly into the output signal. In particular, the first intermediate signal and the second intermediate signal may be identical to one another, or may diverge from one another in terms of their signal components. In particular, the second intermediate signal may also be given by the first directional signal.

On the other hand, based on the estimated target signal and based on the first input signal, a second directional signal may also be generated, with a or the output signal being generated based on the second directional signal, and an output sound signal being generated from the output signal by an output transducer of the hearing device. This means that the signal components of the external input signal now find their way into the output signal. In this case, the filtering of the external input signal with the relative transfer function is again advantageously utilized, which means in particular adapting a phase difference as a result of a transit time difference of the target signal to the external input transducer or the first and second input transducers. Typically, as a result of the uncertain positioning of the external input transducer relative to the hearing device, it is precisely this phase difference that is an obstacle for forming a directional signal based on the external input signal, and this obstacle is eliminated via the relative transfer function by "path filtering" this phase difference. This is particularly advantageous for binaural hearing devices, in which the first and the second input signals are respectively generated in different local devices of the binaural hearing device, because a preferred plane or direction is already defined by the two local devices in space, with respect to which a directional signal that has been generated with the signal components of the external input signal is to be aligned.

The second directional signal or a signal derived therefrom or a second intermediate signal derived from the first input signal and/or the second input signal for generating the second directional signal may additionally also undergo noise suppression, the parameters of which are determined based on the estimated noise signal, in the manner described above. Preferably, the estimated target signal is additionally subjected to a particular one-channel noise suppression before the second directional signal is formed. Preferably, possible volume differences between the estimated target signal and the second intermediate signal or the noise-suppressed second intermediate signal, which may occur due to the greater proximity of the external input transducer to the target signal source and/or due to different sensitivities of the input transducers involved, are balanced prior to forming the second directional signal.

This second objective is achieved, according to the invention, by a hearing device system containing a hearing device with at least a first input transducer for generating a first input signal from an ambient sound signal, an external input transducer for generating an external input signal from the ambient sound signal, and a processor unit which is adapted to carry out the procedure described above. The advantages stated for the method and for its further refinements may be analogously transferred, mutatis mutandis and vice versa, to the hearing device system.

The hearing device system may in particular comprise a second input transducer for generating a second input signal from the ambient sound signal. This second input transducer may be arranged together with the first input transducer in a local device, or the two input transducers may each be arranged in different local devices of a binaural hearing device, so that the two input signals are generated on different sides of the wearer's head. The external input transducer and the processor unit may be arranged in particular in a common housing, wherein even more preferably, means are present for transmitting the signals involved between the hearing device and the processor unit. This may preferably be provided by a mobile telephone, wherein the means for transmission may be furnished in particular via Bluetooth.

Other features which are considered as characteristic for the invention are set forth in the appended claims.

Although the invention is illustrated and described herein as embodied in a method for operating a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
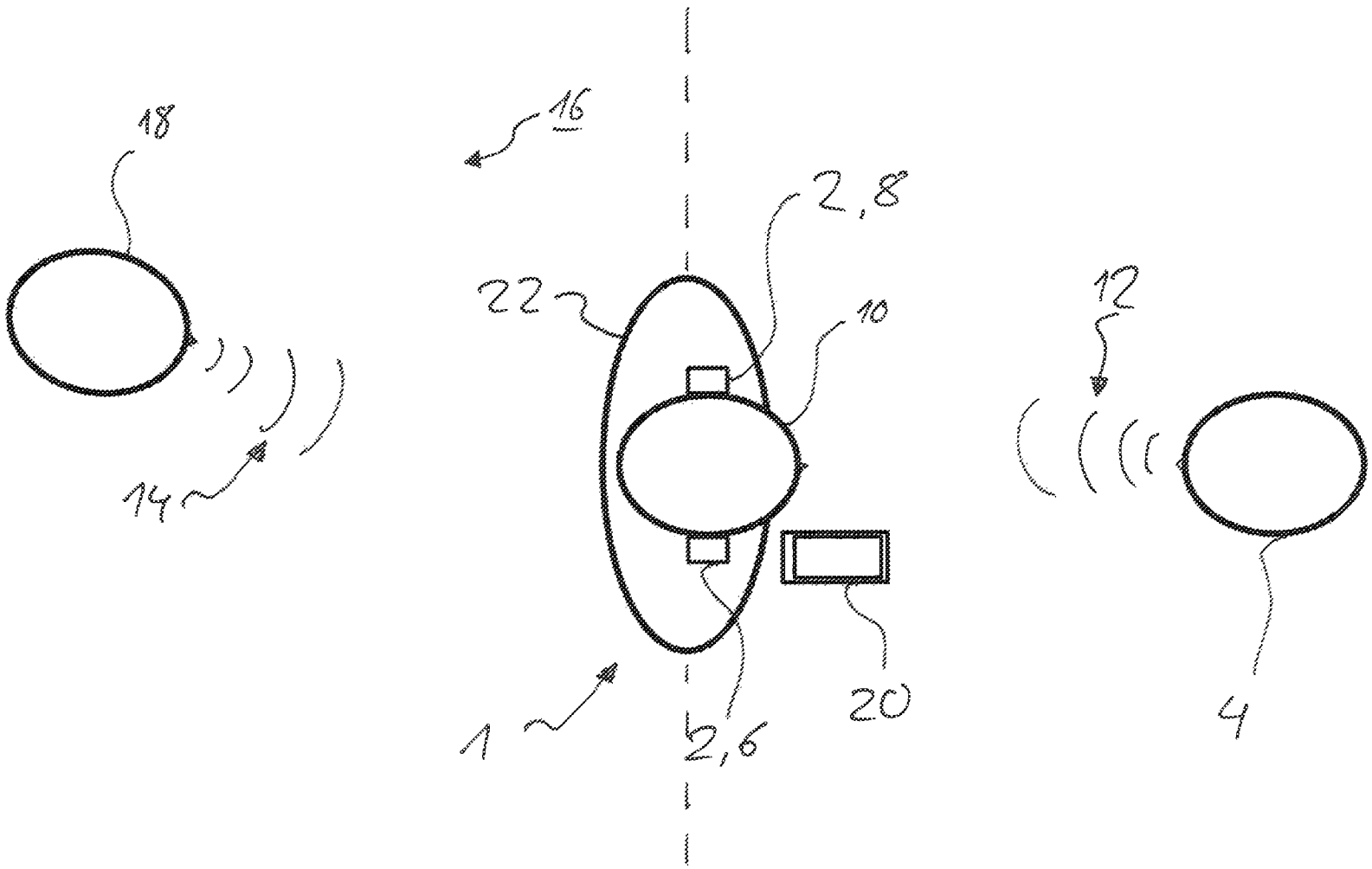
FIG. 1 is an illustration of a wearer of a hearing device in a conversational situation with a conversation partner in front and another speaker.

Corresponding parts and sizes are respectively assigned the same reference numerals in all drawings.

Referring now to the figures of the drawings in detail and first, particularly to FIG. 1 thereof, there is shown in a top view, a wearer 1 of a hearing device 2, who is in a conversation with a frontally positioned conversation partner 4, who is the target signal source in this conversational situation. In the present case, the hearing device 2 is configured as a binaural hearing device with corresponding local devices 6, 8, which the wearer 1 respectively wears on the left or right side of the wearer's head 10. However, the general considerations in the context of the invention also remain valid for a monaural configuration of the hearing device 2. The composition of the sound registered by the hearing device 2 includes the conversational contributions of the conversation partner 4 that make up the target signal 12, but also includes noise components. These noise components in turn may be divided into diffuse background noise, which may not be assigned to a specific origin direction, and directional interference 14, which in the present case is given by a speech contribution of a speaker 18 positioned in the rear hemisphere 16 of the wearer 1.

To be able to better emphasize the target signal 12 with respect to the various noise components, in particular with respect to the directional interference 14, the hearing device 2 falls back on a microphone signal of a mobile telephone 20 in a manner to be described, wherein the wearer 1 wears the mobile telephone 20 in front of the wearer's body 22, and it is thus positioned somewhat closer to the frontal conversation partner 4 than the hearing device 2 is. For noise suppression by means of the microphone signal of the mobile telephone 20 in the hearing device 2, use is made of the fact that the body 22 of the wearer 1 of the hearing device 2 largely shields the mobile telephone 20 against the directional interference 14, and that the mobile telephone 20 is also arranged slightly closer to frontal conversation partner 4 than the hearing device 2 itself is. Both of these facts result in a somewhat improved SNR in the microphone signal of the mobile telephone 20, compared to the signals generated by the hearing device 2.

Figure 2:
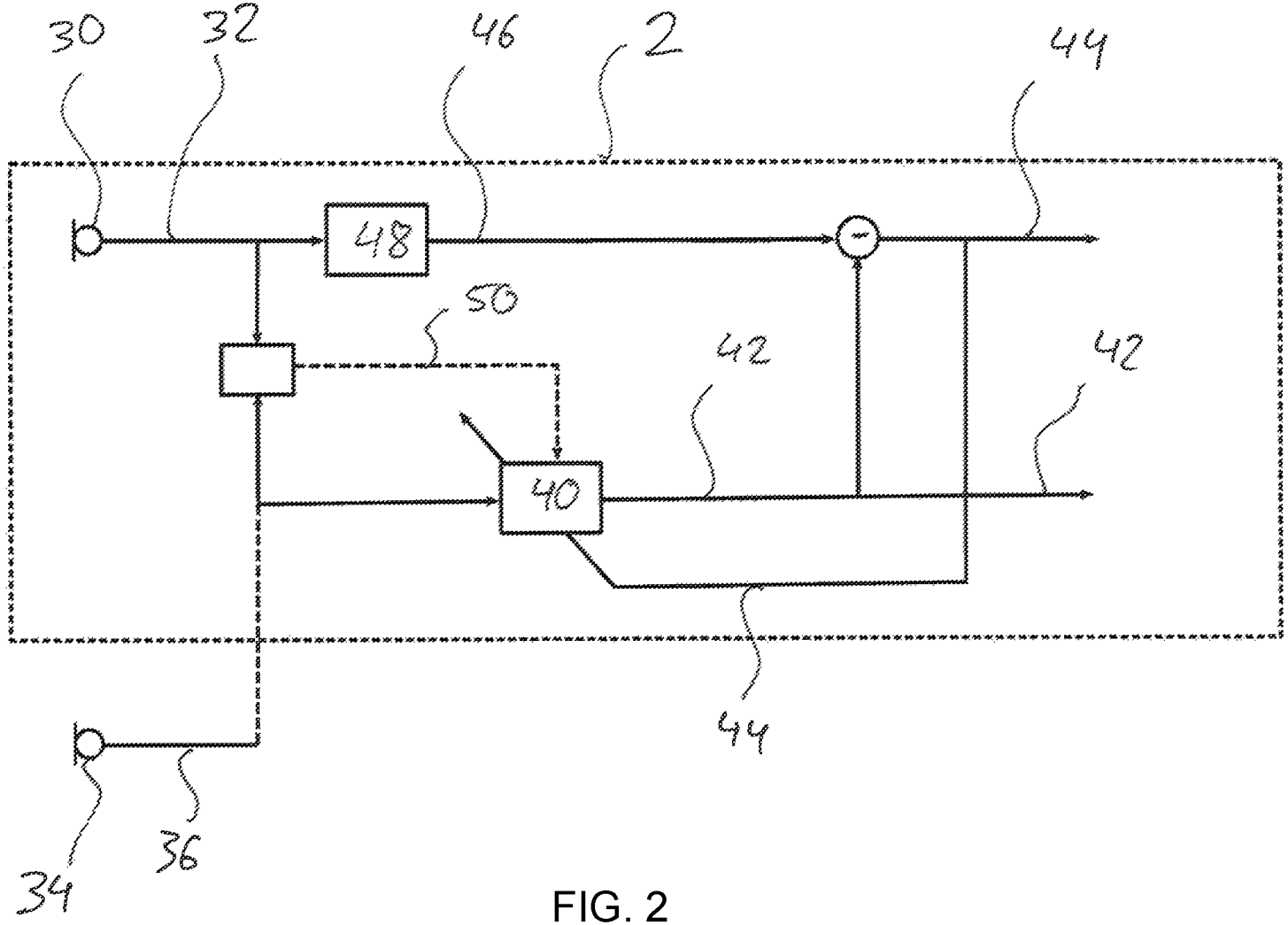
FIG. 2 is a block diagram of a circuit and method for noise suppression in a monaural hearing device by means of an external microphone.

FIG. 2 schematically depicts a block diagram of a method for noise suppression in the hearing device 2. In the present case, the hearing device 2 is configured as a monaural hearing device with only one microphone as the first input transducer 30, which generates a first input signal 32 from the sound signals from the environment. For the suppression of noise in the first input signal 32, an external input signal 36 is generated by an external input transducer 34, which may for example be provided by a microphone of the mobile telephone 20 of FIG. 1, and is transmitted to the hearing device 2. Inside the hearing device 2, the external input signal 36 is fed to an adaptive filter 40, and inside the filter, a relative transfer function from the external input transducer 34 to the hearing device 2 is determined with respect to a target signal source, which is not otherwise shown in FIG. 2. The target signal source may in particular be provided by the conversation partner 4 according to FIG. 1, who is positioned in front of the wearer 1.

By filtering the external input signal 36 using this relative transfer function, i.e. in particular by convolution of the individual samples of the external input signal 36 over the period with the corresponding coefficients of the impulse response of the relative transfer function, an estimated target signal 42 is generated. The construction of the relative transfer function with respect to the target signal source, which is given in the frequency domain by the quotient of the transfer function from the target signal source to the hearing device with the transfer function from the target signal source to the external input transducer, in the ideal case, the estimated target signal 42 delivers the acoustic information relating to the target signal of the target signal source that should be present at the first input transducer 30 of the hearing device 2, but which has been cleaned of directional interference as a result of the shielding effect of the wearer's body, as described with reference to FIG. 1.

To calculate the relative transfer function, the adaptive filter 40 receives a corresponding error signal, which in the present case is given by an estimated noise signal 44. In this case, the estimated noise signal 44 is generated by subtracting from a first intermediate signal 46 the estimated target signal 42 that the adaptive filter 40 generated. In this case, the first intermediate signal 46 is obtained from the first input signal 32 by preprocessing 48. In this case, the preprocessing 48 may in particular already comprise a step for frequency-band-by-frequency-band noise suppression, so that the first intermediate signal 46 in turn already forms a first noise-suppressed signal. By subtracting the estimated target signal 42 from the first intermediate signal 46, the estimated noise signal 44 generated in this way serves as both a quantitative measure of the signal noise remaining on the one hand and as a measure of faulty adaptation of the adaptive filter 40 to the real relative transfer function. Thus, the estimated noise signal 44 may be used in the adaptive filter 40 as an error signal.

To control the adaptive filter, a control signal 50 may be generated based on the first input signal 32 and the external input signal 36, and may directly influence the adaptive filter 40, for example by adjusting the step size in the adaptive filter 40. This may take place, for example, in such a way that the step size of the adaptive filter 40 assumes a positive value as a result of the control signal 50 only if a sufficiently high probability for the presence of a target signal source, in particular in a predetermined direction, results from the first input signal 32 and external input signal 36. The information contained in the estimated noise signal 44 regarding noise components, in particular regarding directional interference, may now be used to further suppress the noise component in the first input signal 32 or the first intermediate signal 46, and the resulting signal may be used for further processing inside the hearing device 2, in which an output signal is generated. However, the first input signal 32 or first intermediate signal 46 may also be superimposed on a directional signal together with the estimated target signal 42, in such a way that the additional noise-suppressing effect of the directional cone may be utilized for remote noise sources.

Figure 3:
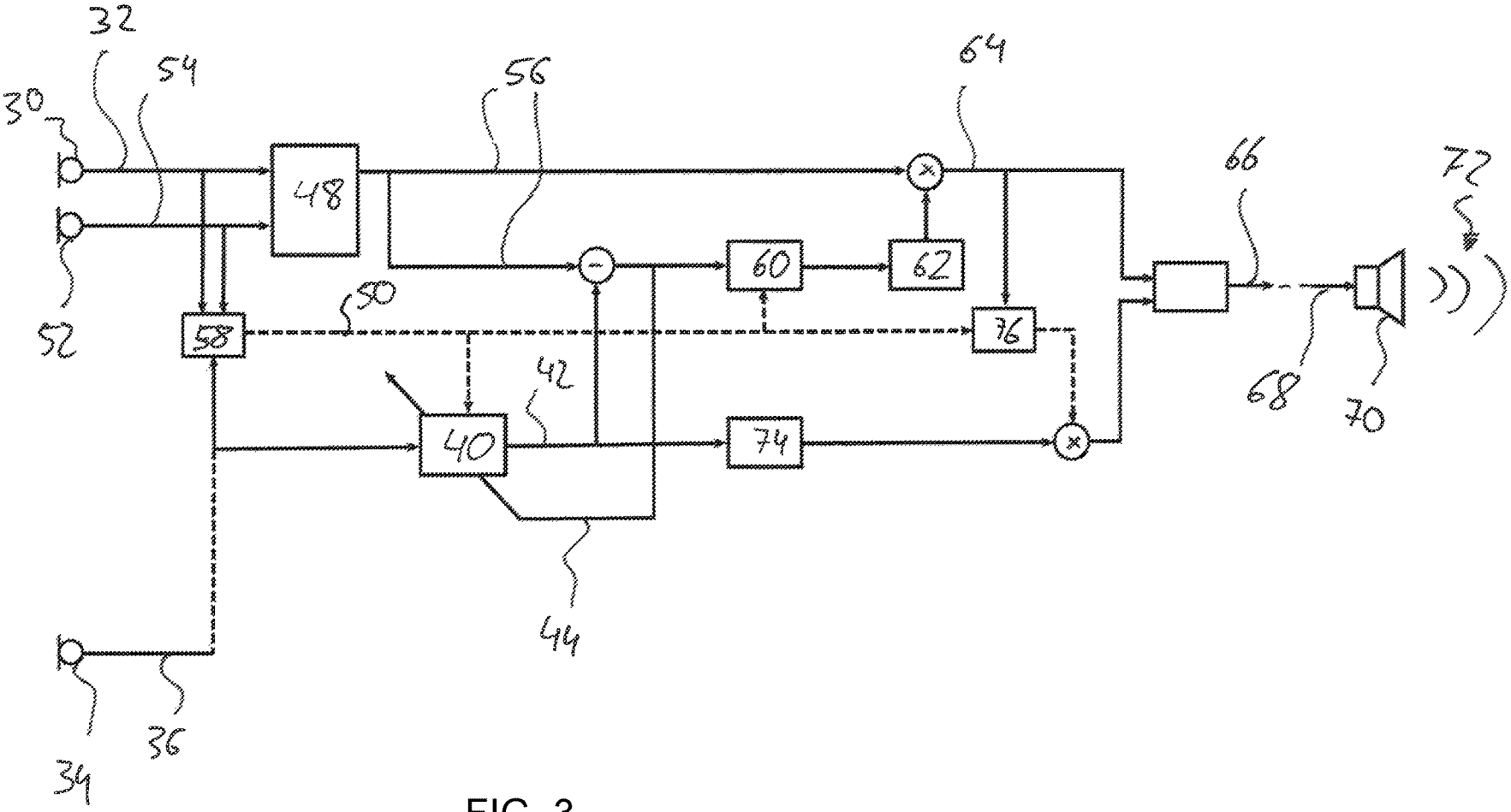
FIG. 3 is a block diagram showing a configuration of the method of FIG. 2 in a binaural hearing device.

FIG. 3 schematically depicts a block diagram of an additional alternative form of the method according to FIG. 2 for noise suppression in a hearing device. The hearing device is configured as a binaural hearing device that has a first input transducer 30 and a second input transducer 52. The first input transducer 30 and second input transducer 52 are respectively arranged in different local devices 6, 8 of the hearing device 2 according to FIG. 1. The signal processing steps described below may be carried out completely in one of the two local devices 6, 8, or partially also in a processor of the mobile telephone 20 that comprises the external input transducer 34.

The first input signal 32, which was generated by the first input transducer 30, and a second input signal 54, which is generated by the second input transducer 52, are further processed in the preprocessing 48 to form a first directional signal 56. As part of generating the first directional signal 56 from the first input signal 32 and second input signal 54, a frequency-band-by-frequency-band noise suppression may take place in particular via the directional cone. This cone is preferably oriented toward the target signal source, so that sounds from other directions are already partially suppressed to a significant degree. Usually, however, a directional characteristic of the first directional signal 56 without the use of further assumptions, which may make the signal processing more complicated, computationally intensive and thus slower, shows a certain symmetry or similar sensitivity with respect to the frontal plane of the wearer 1 of the hearing device 2. This has the consequence that even in the rear hemisphere 16 of the wearer 1 of FIG. 1, a solid angle range exists in which a directional interference 14 is not sufficiently suppressed when forming the first directional signal 56.

In a procedure comparable to the one shown in FIG. 2, the estimated target signal 42 is generated from the external input signal 36 by means of the adaptive filter 40. In this case, the estimated noise signal 44, which is fed as an error signal to the adaptive filter 40, is formed by subtracting the estimated target signal 42 from the first directional signal 56. This is done on the assumption that noise components, particularly those of a diffuse nature, are already suppressed in the first directional signal 56, so that the first directional signal 56 may be considered a first noise-suppressed signal, and thus the deviations from the estimated target signal 42, as a measure of the adaptation or maladaptation of the adaptive filter 40, may be considered on the relative transfer function.

The control signal 50 for controlling the step size of the adaptive filter 40 is formed by forming a probability 58 for the presence of a frontal target signal source from the first input signal 32, second input signal 54 and external input signal 36. From the estimated noise signal 44, a spectral noise power density 60 may now be ascertained. This may in particular be done by weighting the noise of the estimated noise signal 44 with the probability 58 for a frontal target signal source against the noise distribution of the first directional signal 56. Frequency-band-wise weighting coefficients 62, to be applied to the first directional signal 56, may then be ascertained from the spectral noise power density 60. From the noise-suppressed first directional signal 64 and estimated target signal 42, a second directional signal 66 may now be generated that has a further improved SNR with respect to a frontal target signal and is consequently used to form the output signal 68 which is converted into an output sound signal 72 in an output transducer 70 of either of the local devices 6, 8. Here, the second directional signal 66 may be used directly as an output signal 68, or may also be subjected to a frequency band-dependent amplification, in particular to compensate for a hearing impairment of the wearer 1, and optionally subjected to a dynamic compression.

The estimated target signal 42 may also be subjected to an in particular one-channel noise suppression 74 before the second directional signal 66 is formed. Furthermore, a different volume of the target signal component is used in the estimated target signal 42 and the noise-suppressed first directional signal 64, which may result in particular from the different distances of the relevant input transducers 30, 52 and 34 to the target signal source, but also from different sensitivities of the input transducers 30, 52, 34, are compensated for by a corresponding volume adjustment 76 as a function of the probability 58 for a frontal target signal source.

Although the invention has been illustrated and described in detail by means of the preferred exemplary embodiment, this exemplary embodiment does not limit the invention. Other variations may be deduced therefrom by a person of ordinary skill in the art, without departing from the protected scope of the invention.

The following is a summary list of reference numerals and the corresponding structure used in the above description of the invention:

1 Wearer
2 Hearing device
4 Frontal conversation partner
6, 8 Local device
10 Head of the wearer
12 Target signal
14 Directed interference
16 Rear hemisphere
18 Speaker
20 Mobile telephone
22 Body of the wearer
30 First input transducer
32 First input signal
34 External input transducer
36 External input signal
40 Adaptive filter
42 Estimated target signal
44 Estimated noise signal
46 First intermediate signal
48 Preprocessing
50 Control signal
52 Second input transducer
54 Second input signal
56 First directional signal
58 Probability of a frontal target signal source
60 Spectral noise power density
62 Weight coefficient
64 Noise-suppressed first directional signal
66 Second directional signal
68 Output signal
70 Output transducer
72 Output sound signal
74 Single-channel noise suppression
76 Volume adjustment

The invention claimed is:

1. A method for operating a hearing device, which comprises the steps of:

generating, via a first input transducer of the hearing device, a first input signal from an ambient sound signal;

generating, via an external input transducer, an external input signal outside the hearing device from the ambient sound signal;

ascertaining a relative transfer function from the external input transducer to the hearing device with respect to a target signal source based on the first input signal and/or the external input signal;

filtering the external input signal using the relative transfer function resulting in an estimated target signal being generated;

deriving a first noise-suppressed signal from the first input signal;

generating an estimated noise signal by subtracting the estimated target signal from the first noise-suppressed signal; and performing noise suppression in the hearing device based on the estimated target signal and the estimated noise signal.

2. The method according to claim 1, which further comprises determining the relative transfer function by means of an adaptive filter based on the external input signal, wherein the estimated noise signal enters the adaptive filter as an error signal.

3. The method according to claim 2, which further comprises controlling a step size of the adaptive filter in dependence on the first input signal and/or the external input signal.

4. A method for operating a hearing device, which comprises the steps of:

generating, via a first input transducer of the hearing device, a first input signal from an ambient sound signal;

generating a second input signal from the ambient sound signal by a second input transducer of the hearing device;

generating, via an external input transducer, an external input signal outside the hearing device from the ambient sound signal;

generating a first directional signal based on the first input signal and the second input signal;

ascertaining the relative transfer function from the external input transducer to the hearing device with respect to the target signal source based on the first directional signal and the external input signal;

filtering the external input signal using the relative transfer function resulting in an estimated target signal being generated;

generating an estimated noise signal based on the estimated target signal and the first input signal; and performing noise suppression in the hearing device based on the estimated target signal and the estimated noise signal.

5. The method according to claim 4, which further comprises generating the estimated noise signal by subtracting the estimated target signal from the first directional signal.

6. The method according to claim 5, which further comprises determining the relative transfer function by means of an adaptive filter based on the external input signal, wherein the estimated noise signal enters the adaptive filter as an error signal.

7. The method according to claim 6, which further comprises:

ascertaining a probability of the target signal source based on the external input signal and the first input signal and/or the second input signal; and controlling a step size of the adaptive filter in dependence on the probability of the target signal source being a frontal target signal source.

8. The method according to claim 4, which further comprises generating the first input signal and the second input signal respectively in two different local devices of a binaural hearing device.

9. A method for operating a hearing device, which comprises the steps of:

generating, via a first input transducer of the hearing device, a first input signal from an ambient sound signal;

generating, via an external input transducer, an external input signal outside the hearing device from the ambient sound signal;

ascertaining a relative transfer function from the external input transducer to the hearing device with respect to a target signal source based on the first input signal and/or the external input signal;

filtering the external input signal using the relative transfer function resulting in an estimated target signal being generated;

generating an estimated noise signal based on the estimated target signal and the first input signal;

ascertaining a noise suppression parameter based on the estimated noise signal and the noise suppression parameter is applied to a second intermediate signal derived from the first input signal;

generating an output signal from a noise-suppressed second intermediate signal; and generating an output sound signal from the output signal by an output transducer of the hearing device.

10. The method according to claim 9, which further comprises;

generating a second directional signal based on the estimated target signal and the first input signal;

generating the output signal based on the second directional signal; and generating, via the output transducer of the hearing device, the output sound signal from the output signal.

11. The method according to claim 10, wherein the second directional signal is formed from a first directional signal and the estimated target signal.

12. A hearing device system, comprising:

a hearing device having at least one first input transducer for generating a first input signal;

an external input transducer for generating an external input signal; and a processor unit programmed to operating said hearing device to perform the following steps of:

generating, via said at least first input transducer of said hearing device, the first input signal from an ambient sound signal;

generating, via said external input transducer, the external input signal outside said hearing device from the ambient sound signal;

ascertaining a relative transfer function from said external input transducer to said hearing device with respect to a target signal source based on the first input signal and/or the external input signal;

filtering the external input signal using the relative transfer function resulting in an estimated target signal being generated;

deriving a first noise-suppressed signal from the first input signal;

generating an estimated noise signal by subtracting the estimated target signal from the first noise-suppressed signal; and performing noise suppression in said hearing device based on the estimated target signal and the estimated noise signal.

13. The hearing device system according to claim 12, wherein said hearing device additionally has a second input transducer for generating a second input signal.

14. The hearing device system according to claim 12, further comprising a common housing, said external input transducer and said processor unit are disposed in said common housing.

* * * * *